US006230869B1

(12) United States Patent
Barson

(10) Patent No.: US 6,230,869 B1
(45) Date of Patent: May 15, 2001

(54) COIN VALIDATOR

(75) Inventor: Andrew Willian Barson, Cheshire (GB)

(73) Assignee: Coin Controls Ltd, Oldham (GB)

( * ) Notice: Subject to any disclaimer, the term of this patent is extended or adjusted under 35 U.S.C. 154(b) by 0 days.

(21) Appl. No.: 09/101,593

(22) PCT Filed: Nov. 28, 1996

(86) PCT No.: PCT/GB96/02944

§ 371 Date: Jul. 13, 1998

§ 102(e) Date: Jul. 13, 1998

(87) PCT Pub. No.: WO97/27567

PCT Pub. Date: Jul. 3, 1997

(30) Foreign Application Priority Data

Jan. 23, 1996 (GB) ..... 9601335

(51) Int. Cl.[7] ..... G07F 3/02
(52) U.S. Cl. ..... 194/317
(58) Field of Search ..... 194/317, 318, 194/319

(56) References Cited

U.S. PATENT DOCUMENTS

| | | | |
|---|---|---|---|
| 4,376,480 | 3/1983 | Abe | 194/101 |
| 4,469,213 | 9/1984 | Nicholson et al. | 194/100 |
| 4,538,719 | 9/1985 | Gray et al. | 194/100 |
| 4,570,779 | 2/1986 | Abe | 194/318 |
| 4,601,380 | 7/1986 | Dean et al. | 194/318 |
| 4,686,365 | 8/1987 | Meek et al. | 250/281 |
| 4,749,074 | 6/1988 | Ueki et al. | 194/317 |
| 4,754,862 | 7/1988 | Rawicz-Szczerbo et al. | 194/319 |
| 4,845,994 | 7/1989 | Quinlan, Jr. | 73/163 |
| 4,951,800 | 8/1990 | Yoshihara | 194/317 |
| 4,995,497 | 2/1991 | Kai et al. | 194/318 |
| 5,007,520 | 4/1991 | Harris et al. | 194/317 |
| 5,033,603 | 7/1991 | Kai et al. | 194/334 |
| 5,062,518 | 11/1991 | Chitty et al. | 194/317 |
| 5,067,604 * | 11/1991 | Metcalf | 194/317 X |
| 5,083,652 * | 1/1992 | Kobayashi et al. | 194/318 |
| 5,085,309 | 2/1992 | Adamson et al. | 194/317 |
| 5,131,518 * | 7/1992 | Shimizu | 194/318 |
| 5,155,960 | 10/1992 | Shaanan | 52/584 |
| 5,158,166 | 10/1992 | Barson | 194/319 |
| 5,180,046 | 1/1993 | Hutton et al. | 194/319 |
| 5,226,520 | 7/1993 | Parker | 194/317 |
| 5,379,876 | 1/1995 | Hutton | 194/319 |
| 5,462,149 * | 10/1995 | Waine et al. | 194/317 X |
| 5,469,952 | 11/1995 | Kershaw et al. | 194/317 |
| 5,489,015 | 2/1996 | Wood | 194/318 |
| 5,515,960 | 5/1996 | Wood | 194/328 |
| 5,577,591 | 11/1996 | Abe | 194/343 |
| 5,657,847 | 8/1997 | Tod et al. | 194/207 |

FOREIGN PATENT DOCUMENTS

| | | | |
|---|---|---|---|
| 0155126 | 9/1985 | (EP) . | |
| 0164110 | 12/1985 | (EP) . | |
| 0 384 375 | 8/1990 | (EP) | G07F/3/02 |

(List continued on next page.)

*Primary Examiner*—Christopher P. Ellis
*Assistant Examiner*—Thuy V. Tran
(74) *Attorney, Agent, or Firm*—Morgan & Finnegan LLP

(57) ABSTRACT

A coin validator is operable in a set up mode prior to normal operation, in which initial window data (W) stored in its memory, is compared with data from a known true coin, and the initial window is progressively dragged and shrunk depending on the outcome of the comparison, to produce an operating window (W'), narrower than the initial window, which can be used during normal operation of the validator, for comparison with coin data (x) from coins under test, in order to determine coin acceptability. The initial window (W) can be the same for all validators of the same design, and the dragging and shrinking configures the operating window (W') to the validators individually, to take account of manufacturing tolerances.

27 Claims, 2 Drawing Sheets

FOREIGN PATENT DOCUMENTS

| | | | | |
|---|---|---|---|---|
| 0 404 432 | | 12/1990 | (EP) | G07F/3/02 |
| 0 155 126 B1 | | 2/1991 | (EP) | G07F/3/02 |
| 0 164 110 | | 9/1991 | (EP) | G07F/3/02 |
| 0 384 375 B1 | | 10/1993 | (EP) | G07F/3/02 |
| 0 404 432 B1 | | 9/1994 | (EP) | G07F/3/02 |
| 418423 | | 11/1934 | (GB) . | |
| 2 094 008 | | 9/1982 | (GB) | G01R/19/04 |
| 2 169 429 | | 7/1986 | (GB) | G07D/5/08 |
| 2182477 | * | 5/1987 | (GB) | 194/317 |
| 2 200 778 | | 8/1988 | (GB) | G07D/5/00 |
| 2 238 152 | | 5/1991 | (GB) | G07F/3/02 |
| WO 85/04037 | | 9/1985 | (WO) . | |

* cited by examiner

COIN VALIDATOR

FIELD OF THE INVENTION

This invention relates to a coin validator and is particularly concerned with setting up coin acceptance windows for comparison with coin data derived from coins to be validated, in order to determine coin acceptability.

BACKGROUND

Coin validators which discriminate between coins of different denominations are well known and one example is described in our GB-A-2 169 429. This coin validator includes a coin rundown path along which coins pass edgewise through a sensing station at which coils perform a series of inductive tests on the coins to develop coin parameter signals which are indicative of the material and metallic content of the coin under test. The coin parameter signals are digitised so as to provide digital coin parameter data, which are then compared with stored data by means of a microprocessor to determine the acceptability of otherwise of the coin under test. If the coin is found to be acceptable, the microprocessor operates an accept gate so that the coin is directed to an accept path. Otherwise, the accept gate remains inoperative and the coin is directed to a reject path.

The stored data is representative of acceptable values of the coin parameter data. The stored data in theory could be represented by a single digital value but in practice, the coin parameter data varies from coin to coin, due to differences in the coins themselves and consequently, it is usual to store window data corresponding to windows of acceptable values of the coin parameter data. The width of the windows is a compromise between a number of factors. In order to achieve satisfactory discrimination between true and false coins, the window widths should be made as narrow as possible. However, if the windows are made too narrow, there is a risk that true coins will be rejected as a result of minor differences between the characteristics of true coins.

Another problem is that the window data needs to vary from validator to validator due to minor manufacturing differences that occur between validators manufactured to the same design. Consequently, it is not possible to program a fixed set of window data into mass produced coin validators of the same design. A conventional solution to this problem is to calibrate coin validators individually by passing a series of known true coins of a particular denomination through the validator so as to derive test data from which appropriate window data can be computed and stored in the memory of the validator. Reference is directed to GB-A-1 452 740. This calibration method is however time consuming because a group of test coins for each denomination needs to be passed through the validator in order to derive data from which the w windows can be computed. Alternative techniques are disclosed in WO94/04998 and U.S. Pat. No. 5,067,604.

The present invention provides an alternative approach which allows a single set of window data to be used for all coin validators for a particular design, notwithstanding differences in their characteristics that arise within normal manufacturing tolerances, from validator to validator.

SUMMARY OF THE INVENTION

In accordance with the invention there is provided a coin validator comprising: means for producing coin parameter data as a function of a characteristic of a coin under test; means for comparing the coin data with window data corresponding to a window of acceptable values within a range of values for the coin parameter data, for determining coin acceptability; and window set up means operable during a set up mode prior to normal operation of the validator, said set up means comprising: memory means storing initial window data corresponding to an initial window with an initial width within said range of values; control means for deriving operating window data corresponding to an operating window of values in said range of values, in response to coin parameter test data derived from a known true coin validation performed by the validator for the set up mode, said control means being operative to drag the initial window through the range of values of coin data by an amount determined in response to the coin parameter test data, and to shrink the width of the initial window so as to derive the operating window; and means for switching the validator from the set up mode to a normal operating mode in which the comparing means compares the coin data from coins to be validated with the operating window data derived during the set up mode, for determining coin acceptability based on said operating window.

In accordance with the invention, the same initial window data may be stored in the memory of each individual coin validator of the same design. The initial window data can constitute an approximation of the desired operating window, but with a window width which is sufficiently broad to cover all manufacturing tolerances that can be expected for the particular validator design. During the set up mode, the operating window data is produced for each individual validator in response to a coin test performed by the individual validator, by dragging and shrinking the initial window in order to produce operating an window data specific to the validator concerned, which can satisfactory discrimination between true coins and frauds.

This has the significant advantage that it is not necessary to feed a large number of coins through the validator for calibration purposes at the time of manufacture. Instead, the calibration can be performed by the user, as an initial set up procedure, whereafter the set up means is disabled and the validator switched to normal operating mode.

The invention extends to a method of setting up an operating window in a coin validator which in a normal operating mode produces coin parameter data as a function of a characteristic of a coin under test and compares the coin data with operating window data corresponding to an operating window of acceptable values within a range of values for the coin parameter data, for determining coin acceptability; wherein prior to the setting up the operating window, initial window data has been stored in a memory means in the validator, the initial window data corresponding to an initial window within said range of values, that approximates to the operating window; the setting up method comprising: performing a validation operation with the validator with a known true coin so as to produce coin parameter test data; deriving operating window data corresponding to an operating window in said range of values of coin data, by dragging the initial window through the range by an amount determined in response to the coin parameter test data, and shrinking the width of the initial window; and thereafter switching the validator into said normal operating mode in which coin data from coins to be validated are compared with the operating window data for determining coin acceptability.

The method according to the invention permits remote setting up of coin validators. For example, the validators may be manufactured and sold with no initial window data in their memories. Initial window data corresponding to a coin set of a particular currency may be supplied together with the validators so that it can be loaded into the validators in the country of sale. For example, if the validators are manufactured in the United Kingdom and then sold in Brazil, validators may be supplied with initial window data on a floppy disc or some other suitable memory, so that it can be loaded at the point of sale by the local distributor of the validators. The set up procedure can be carried out by the local distributor or can be carried out by the purchaser of the validator. Once the set up has been performed with a set of local currency coins, the set up procedure is disabled.

Moreover, if the coin set for the country concerned is subsequently changed, for example to introduce a new coin, a revised set of initial window data may be supplied by the manufacturer to the distributor in the country concerned which can be re-loaded into the validators. The initial window data or the revised initial window data may be supplied e.g. by e-mail to a personal computer (PC), which can be used to download the information into individual validators. The distributor in the country concerned will be provided with a tool which permits the lock on the set up means to be released temporarily in order to permit re-programring of the initial window data.

Thus the invention greatly simplifies the manufacturing procedure for the validators due to the fact that it is no longer necessary to pass large numbers of coins through the validators in order to calibrate them in the factory. Instead, the initial window data can be loaded in the memory of all validators of a particular type, either in the factory or by the distributor, and then the aforesaid set up procedure may be carried out by the distributor or the customer.

BRIEF DESCRIPTION OF THE DRAWINGS

In order that the invention may be more fully understood, an embodiment thereof will now be described by way of example, with reference to the accompanying drawings in which.

DETAILED DESCRIPTION

Figure 1:
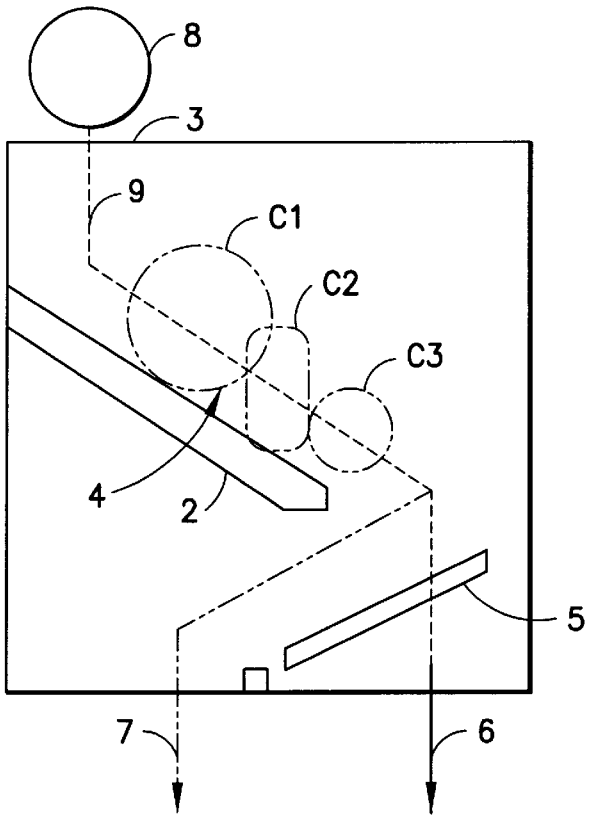
FIG. 1 is a schematic part sectional view of a coin validator in accordance with the invention.

Referring to FIG. 1, this shows the basic physical layout of the coin validator. The validator includes a body 1 with a coin rundown path 2 along which coins under test pass edgewise from an inlet 3 through a coin sensing station 4 and then fall towards a gate 5. If the test performed at the sensing station 4 indicates a true coin, the gate 5 is opened so that the coin can pass to an accept path 6, but otherwise the gate remains closed and the coin is deflected to a reject path 7. The coin path through the validator for a coin 8 is shown schematically as dotted line 9.

Figure 2:
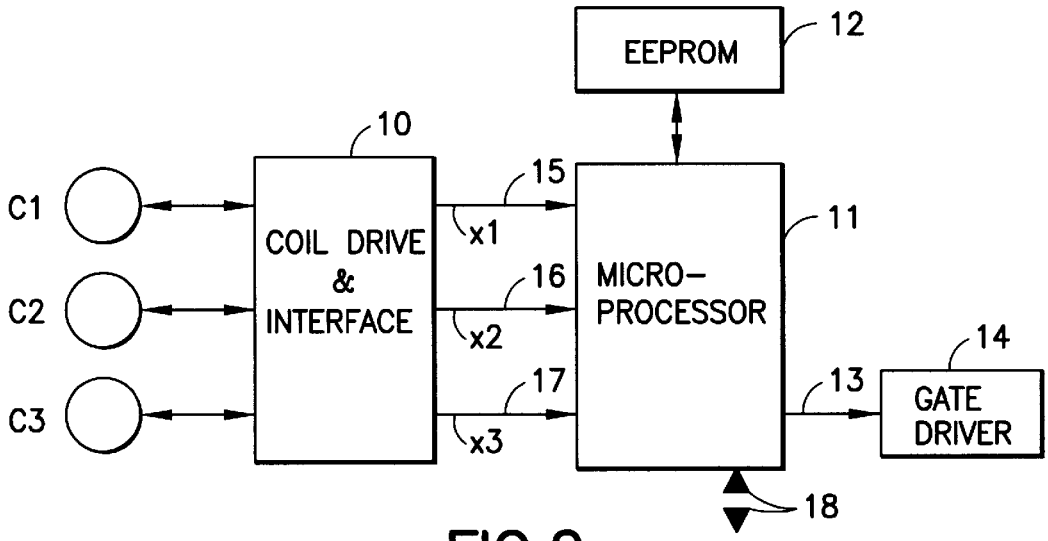
FIG. 2 illustrates schematically the electrical circuits of the validator shown in FIG. 1.

The coin sensing station 4 includes three coin sensing coils C1, C2, C3 shown in dotted outline, which are energised in order to produce an inductive coupling with the coin. The coils are of different geometrical configurations and are energised at different frequencies by a drive and interface circuit 10 shown in FIG. 2. The different inductive couplings between the three coils and the coin have been found to characterise the coin substantially uniquely in terms of its metallic content and physical dimensions. The drive and interface circuit 10 produces three corresponding coin parameter data signals $x_1$, $x_2$, $x_3$ as a function of the different inductive couplings between the coin and the coils C1, C2, C3. The coin parameter data signals $x_1$, $x_2$, $x_3$ can be formed in a number of different known ways, for example as is described in detail in our GB-A-2 169 429. In this method, the coils are included in individual resonant circuits which are maintained at their natural resonant frequency as the coin passes the coil. The frequency changes on a transitory basis as a result of the momentary change in impedance of the coil, produced by the inductive coupling with the coin. This change in impedance produces a change both in amplitude and frequency. As described in our prior specification, the peak amplitude is monitored and digitised in order to provide the coin parameter signal x for each coil. By maintaining the drive frequency for the coil at its natural resonant frequency during passage of the coin past the coil, the amplitude deviation is emphasised so as to aid in discrimination between coins. However, the coin parameter signals x can be formed in other ways, for example by monitoring the frequency deviation produced as the coin passes the coil and reference is directed to GB 1 452 740.

In order to determine coin authenticity, the three parameter signals $x_1$, $x_2$, $x_3$ produced by a coin under test are fed to a microprocessor 11 which is coupled to memory means in the form of an EEPROM 12. The microprocessor 11 compares the coin parameter signals derived from the coin under test with corresponding stored values held in the EEPROM 12. The stored values are stored in terms of windows having upper and lower limits. Thus, if the individual coin parameter signals $x_1$, $x_2$ and $x_3$ fall within the corresponding windows associated with a true coin of a particular denomination, the coin is indicated to be acceptable, but otherwise is rejected. If acceptable, a signal is provided on line 13 to a drive circuit 14 which operates the gate 5 shown in FIG. 1 so as to allow the coin to pass to the accept path 6. Otherwise, the gate is not opened and the coin passes to reject path 7. It will be appreciated that the microprocessor compares the coin parameter data signals $x_1$, $x_2$ and $x_3$ with a number of different sets of operating window data appropriate for coins of different denominations so that the coin validator can accept or reject more than one coin of a particular currency set.

Normnal Oerating Mode

The operation of the validator described so far constitutes its normal operating mode, in which coin parameter data signals $x_1$, $x_2$ and $x_3$ are compared with operating window data from the EEPROM 12 by means of the microprocessor 11, the operating window data having been pre-stored in the EEPROM for a number of true coins of different denominations. The validator is also initially operable in a set up mode in which the operating window data is set up in the EEPROM 12. This set up mode will now be described in detail.

Set up Mode

In accordance with the invention, the EEPROM 12 is initially loaded with a set of initial window data which defines windows for the coin parameter data signals $x_1$, $x_2$, and $x_3$, which are an approximation to the final window data required for the particular validator. Each of the initial windows defined by the initial window data has an upper and lower limit value stored in the EEPROM 12. The difference between the upper and lower limits for each window, namely the window width, is selected to be wider than the final operating window for the particular validator. During the set up mode, the initial window data is processed in response to a test coin fed through the validator, so as to drag the initial window and then shrink it, so as to take account of the manufacturing differences that occur from validator to validator. By means of the invention, the same set of initial window data can be loaded into the EEPROMs of all coin validators manufactured according to a particular design and then during the set up mode, the initial window data is modified by the window dragging and shrinking procedure so as to achieve a window width which provides satisfactory discrimination between true and fraudulent coins. The initial window data may be loaded into the EEPROMs as part of the manufacturing process in the factory but the set up mode may be performed with test coins by a distributor or customer or final user of the validator prior to switching to the normal operating mode. However, there are other possibilities which will be discussed after the following detailed description of one example of the procedure carried out in the set up mode.

Figure 3:
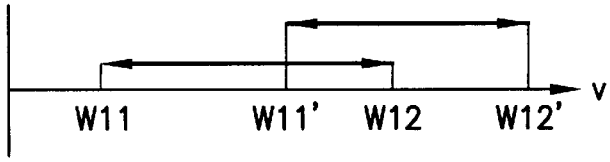
FIG. 3 is a schematic illustration of the initial window data and the operating window data derived therefrom, for a particular acceptance window.

In the following description, the setting up of one operational window will be described, for comparison with one of the coin parameter data signals e.g. $x_1$, it being understood that a plurality of such windows will be provided for coins of different denominations for the signal $x_1$, and also that a plurality of windows will also be provided for each of the other parameter signals $x_2$ and $x_3$. Referring to FIG. 3, the relationship between the initial window data for one example of a window and the corresponding operating window data is shown. An initial window W has upper and lower limits W11 and W12. The set up procedure drags and shrinks the window so as to produce an operating window W' having lower and upper limits W11' and W12'.

Figure 4:
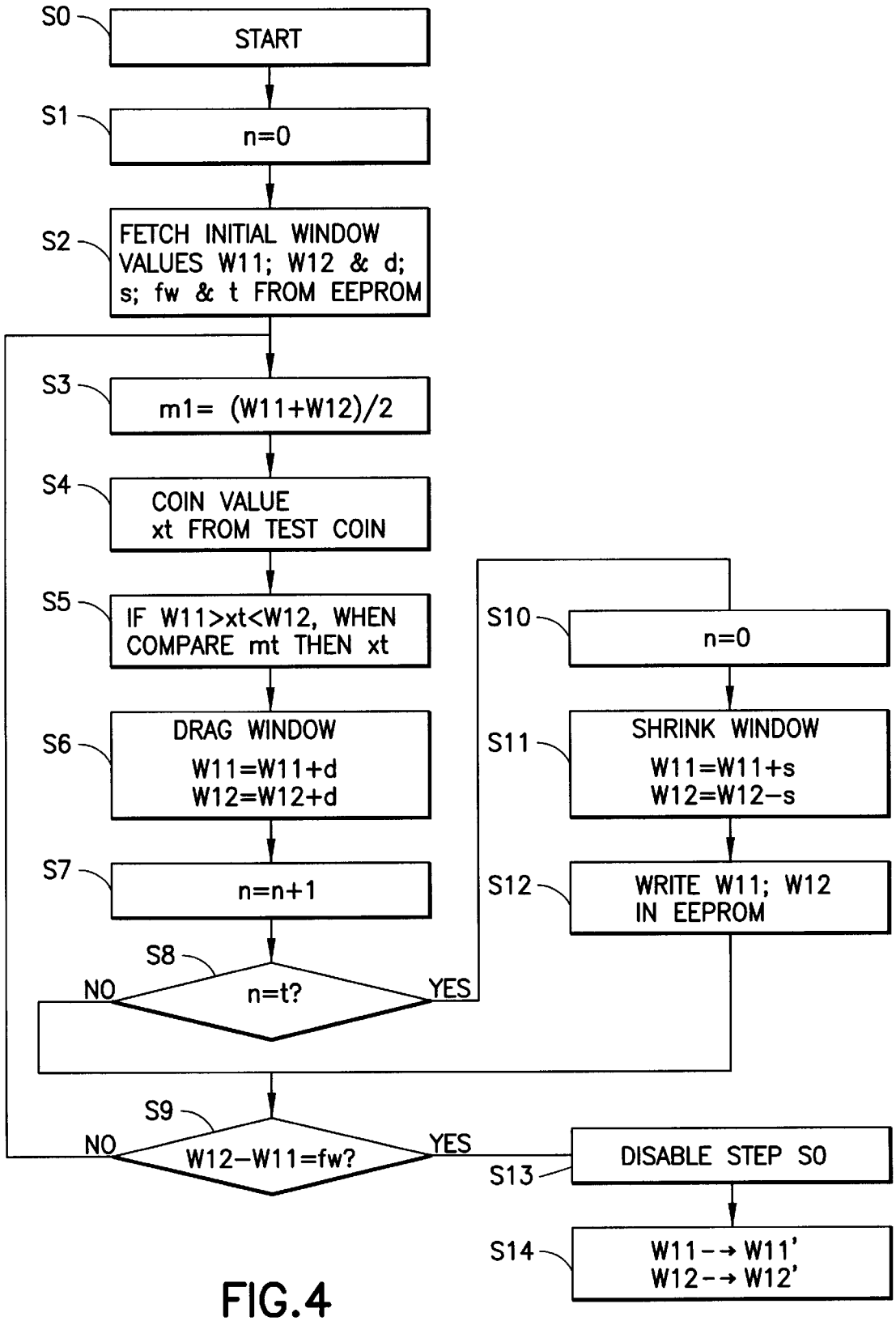
FIG. 4 is a schematic flow diagram of a window shrinking and dragging process performed by a processor shown in FIG. 2 during its setting up operation for the acceptance windows.

The microprocessor 11 performs the routine shown in FIG. 4 during the set up mode. The routine starts at step S0. The shrinking and dragging is performed in a series of sequential steps until the eventual window is shrunk to a size that is less than a preset value fw stored in the mnicroprocessor's memory. The routine performs a series of dragging steps followed by a shrinking step and then the entire process is repeated for a sufficient number of times to achieve the desired eventual window width. In the routine, the eventual window width fw is stored as a digital number for the window concerned in the EEPROM 12. The amount of dragging d performed during each dragging step is also stored in the memory, together with a digital value s which defines the amount by which the window is shrunk for each shrinking step. A parameter t stored in the EEPROM defines the number of dragging steps performed for each shrinking step, as will be explained hereinafter. For this example d=1; s=1; t=3; and fw=13

At step S1, an operating parameter n for the routine is set to zero. At step S2, the initial window data for window W is retrieved from EEPROM 12. Also, the stored values of d, s, fw and t are fetched from the EEPROM 12 for the window concerned.

At step S3, the midpoint m1 of the window W is computed according to the following equation:

$$m1=(\mathbf{W11}+\mathbf{W12})/2 \quad (1)$$

The initial values of the window data W11, W12 fetched from the EEPROM can be seen in the first line of the Table hereinafter. In this example, the values of W11 and W12 are 100 and 120 in the arbitrary units of computation performed by the microprocessor. It will be understood that the values W11 and W12 are stored as digital numbers in the EEPROM. The width of the initial window (W12–W11) is 21 and the value of the midpoint m1 computed at step S3 is 110.

Thereafter, a true coin is fed into the validator. This known true coin is of a known denomination corresponding to the initial window data. The driver interface circuitry 10 shown in FIG. 2 produces a corresponding set of coin parameter test data x on lines 16 and 17. Referring to FIG. 4, coin parameter test data $x_t$, produced on line 15 is derived at step S4.

TABLE

| | No: n = | test data $x_t$ | W11 | W12 | Width | m1 | Operation |
|---|---|---|---|---|---|---|---|
| | — | — | 100 | 120 | 21 | 110 | Setup |
| R1 | 0 | 115 | 101 | 121 | 21 | 111 | Drag |
| | 1 | 114 | 102 | 122 | 21 | 112 | Drag |
| | 2 | 115 | 103 | 123 | 21 | 113 | Drag |
| | 3 | — | 104 | 122 | 19 | 113 | Shrink |
| R2 | 0 | 116 | 105 | 123 | 19 | 114 | Drag |
| | 1 | 115 | 106 | 124 | 19 | 115 | Drag |
| | 2 | 115 | 106 | 124 | 19 | 115 | No Change |
| | 3 | — | 107 | 123 | 17 | 115 | Shrink |
| R3 | 0 | 116 | 108 | 124 | 17 | 116 | Drag |
| | 1 | 116 | 108 | 124 | 17 | 116 | No Change |
| | 2 | 115 | 107 | 123 | 17 | 115 | Drag |
| | 3 | — | 108 | 122 | 15 | 115 | Shrink |
| R4 | 0 | 115 | 108 | 122 | 15 | 115 | No Change |
| | 1 | 115 | 108 | 122 | 15 | 115 | No Change |
| | 2 | 116 | 109 | 123 | 15 | 116 | Drag |
| | 3 | — | 110 | 122 | 13 | 116 | Shrink |

At step S5, the value of the test data $x_t$ is compared with the midpoint m1 of the initial window to provide an indication of whether the initial window needs to be dragged upwardly or downwardly. Firstly, the value of $x_t$ is compared with the upper and lower values of the window W12 and W11 to see whether the test data is appropriate to the window concerned. If not, the routine is terminated in order to prevent the validator being set up with a fraudulent test coin. However, if the test data $x_t$ lies within the window, its value is compared with the value of m1. If the difference between the value of m1 and $x_t$ is positive, the sign of the integer d is set to be positive. Conversely, if the difference between m1 and $x_t$ is negative, the sign of the integer d is set to be negative. If the difference between m1 and $x_t$ is zero, the midpoint of the initial window is aligned with the coin parameter test data and no window dragging is required.

The test performed at step S5 can be summarized as follows:

$$(m1-xt)>0;\ d \text{ is positive} \quad (2)$$

$$(m1-xt)<0;\ d \text{ is negative} \quad (3)$$

$$(m1-xt)=0;\ d=0 \quad (4)$$

At step S6, the window is dragged. The value of the dragging integer d is added to the values of W11, W12 and m1. This can be summarised by the equations shown below:

$$W11 \rightarrow W11+d \quad (5)$$

$$W12 \rightarrow W12+d \quad (6)$$

The resulting set of data values is shown in the second line of the Table. In this example, the coin test data $x_t$ has a digital value 115, and, as previously mentioned, in this example, d=1. Thus, from equation (2), d is positive and the window is to be dragged upwardly. Consequently, the values of W11, W12 are incremented upwardly by 1 to assume the value shown in line 2 of the Table.

Then, at step S7, the parameter n is incremented so that n assumes the value n=1. The routine then passes through decision points at S8 and S9 described in more detail hereinafter, to return to step S3 where the value of the midpoint m1 is recomputed for the dragged window. Then the midpoint m1 assumes the value 112 shown in line 3 of the Table.

Then another coin of the same known denomination is passed through the validator to produce a second sample of the coin parameter test data $x_t$. The process steps S4, S5 and S6 are repeated. Referring to the Table, third line, where n=1, the value of the second sample of coin test data $x_t$=114, which is greater than the current value (m1=112) of the window midpoint m1 and consequently, the window is dragged upwardly by an other integer value, and the values of W11, W12 are increased by 1. The integer n is then incremented at step S7 and the process is repeated again for n=2, for which the test data $x_t$=115, so that the window is dragged as shown by the data in the fourth line of the Table. By this described process, the window is dragged so that its midpoint is moved towards the average value of the coin test data $x_t$ produced by the sequence of test coins.

As previously described, parameter t determines when a window shrinking operation is to be performed. In this example t=3. Thus, at step S8, when n=3, the routine branches to step S10 where the parameter n is reset to zero. Then, a window shrinking operation is performed at step S11. The parameter s that was initially read at step S2 constitutes a shrinking integer which is added to the lower window limit and subtracted from the upper window limit as follows:

$$W11 \rightarrow W11+s \quad (6)$$

$$W12 \rightarrow W12-s \quad (7)$$

In this example, the value of the shrinking integer s=1 so that the window width is reduced from 21 to 19, as shown in the fifth line of the Table.

The resulting values of the window limits W11, W12 are then written back into the EEPROM 12 as shown at step S12. This step is performed for security purposes in case the power is interrupted during the set up process.

Ideally, the outcome of each dragging step S6 should also be written back into the EEPROM 12 but the writing process is relatively slow compared to the operation of the routine and so as a compromise, only the shrinking steps are written back into the EEPROM i.e. every third step. The values that are written back sequentially over-write the previously stored values.

The dragging and shrinking steps described so far constitute a routine $R_1$, as shown in the Table. The routine is then repeated a number of times in order to perform further shrinking and dragging operations and further routines $R_2$, $R_3$ and $R_4$ are shown in the Table. The process is continued until the width of the window has become shrunken to a value equal to a stored value for the window defined by parameter fw. In this example, fw=13. After each cycle of the routine, the resulting window width is compared with the value of the parameter fw at step S9. If the window width is greater than fw the previously described process is repeated but if the window width is equal to the parameter fw, the routine moves to step S13 and S14 in which the current values of the window limits are accepted as the lower and upper limits W11' and W12' for the operating window W'. Also, at this stage, step S13 disables the entire routine by disabling step S0. Thus, the set up routine is disabled and the microprocessor can then be switched to operate in the normal operating mode.

Thus, from the foregoing it can be seen that the initial window data can be a rough approximation of the operating window data, which is "fine-tuned" by the dragging and shrinking process that is performed in the set up mode. Thus, the initial window data can be programmed into a number of validators of the same design during the manufacturing process, without the need to calibrate each individual validator at the time of manufacture. Instead, the set up mode can be performed by the distributor or user of the validator. When initially switched on, the validator will offer the user the set up mode during which test coins of known denomination are passed through the validator to cause the shrinking and dragging of the windows as described with reference to FIGS. 3 and 4. Thereafter, the validator automatically switches to the normal operating mode (at step S13) and the user cannot reactivate the step up mode in order to prevent fraudsters from reprogramming the validator with fraudulent coins.

The window shrinking and dragging that is carried out in the set up mode is thus performed by means of programs stored in the microprocessor 11, without the requirement for external control apparatus as typically used in the prior art when validators are calibrated in the factory by using large numbers of test coins.

The invention also lends itself to the remote setting up of coin validators. For example, the microprocessor 11 may be provided with an external connection 18 to its data bus in order to allow a conventional programming tool to be connected. The tool may constitute a interface with a conventional PC. Thus, in a modification, the validators of a particular design manufactured in a factory may not have any initial window data programmed therein and instead, the initial window data may be supplied on a floppy disc or some other suitable storage medium. The wholesalers or distributors of validators may themselves program the initial window data into a group of validators of the same design. Thus, validators can be supplied to different countries that have different national coin sets, accompanied by a suitable floppy disc to enable the initial window data to be set up locally in the country concerned. The individual validators may then be subject to a setting up operation in the set up mode as previously described, either by the wholesaler or distributor or by the customer.

The described method also permits amendments to be made to the operating window data, in the field, in the event of changes to the coin set to be accepted by the validator. This may occur when a new coin is introduced in a particular country or whether the customer wishes to change the set of coins to be accepted by the validator. For example, customer X in Brazil may require recognition of a new set of coins in 20 coin validators. The customer contacts the manufacturer by telephone and then an appropriate file from a master coin database residing on the manufacturers file server can be sent by modem or e-mail to Brazil, to the customer's PC. The validators are then individually connected to the PC through an interface connected to line 18 (FIG. 2), or to a hand held programming device, in order to re-program the initial coin data, and to reactivate the set up mode routine (FIG. 4) for the re-programmed initial coin data windows. The customer can then pass the new coins through the validator to operate the set up routine and consequently re-program the validator to take account of the new coin. Thereafter, the set up routine is de-activated at step S13, as previously described.

Thus, a plurality of validators of the same design can be selectively re-programmed with common initial window data, notwithstanding differences in manufacturing tolerances between the individual validators, and the set up mode permits compensation to be performed for differences which lie within the normal manufacturing tolerances for the validators.

Many modifications and variations of the described set up routine fall within the scope of the claimed invention. For example, the dragging may be carried out as a two stage process in which the window is initially dragged with a relatively large value of d and thereafter a smaller value is used for fine adjustment.

As used herein, the term "coin" includes a token or like item of credit which can be used like a coin in the coin validator.

I claim:

1. A coin validator comprising:

means for producing coin parameter data as a function of a characteristic of a coin under test;

means for comparing the coin data with window data corresponding to a window of acceptable values within a range of values for the coin parameter data, for determining coin acceptability; and window set up means operable during a set up mode prior to normal operation of the validator, said set up means comprising:

memory means storing initial window data corresponding to an initial window with an initial width within said range of values;

control means for deriving operating window data corresponding to an operating window of values in said range of values, in response to coin parameter test data derived from a known true coin validation performed by the validator for the set up mode, said control means being operative to drag the initial window through the range of values of coin data by an amount determined in response to the coin parameter test data, and to shrink the width of the initial window so as to derive the operating window; and means for switching the validator from the set up mode to a normal operating mode in which the comparing means compares the coin data from coins to be validated with the operating window data derived during the set up mode, for determining coin acceptability based on said operating window.

2. A validator according to claim 1 wherein the initial window is disposed in said range of values so as to approximate to an acceptable range for coin parameter data for a particular coin denomination, and said control means is responsive to the coin parameter test data, for changing the initial window data and deriving the operating window data such that it corresponds to said acceptable range of values, specific to the validator.

3. A validator according to claim 2 wherein the coin parameter test data is derived during the set up mode with at least one known true coin of said particular denomination.

4. A validator according to claim 1 wherein the initial window has upper and lower limits with predetermined values in said range, and an intermediate value in a predetermined relationship to the upper and lower limit values, and the control means is operative to compare the intermediate value with the coin parameter test data and alter the upper and lower limit in dependence upon the result of the comparison.

5. A validator according to claim 4 wherein the control means produces a shift in both the upper and lower limits of the initial window by a predetermined amount in either an upward or a downward direction depending on the sign of the difference between the intermediate value and the value of the coin parameter test data.

6. A validator according to claim 5 wherein the coin parameter test data is derived from a plurality of coin tests for a particular denomination performed in a sequence and the control means performs said shift in response to each of the sequential tests, whereby to drag the window sequentially.

7. A validator according to claim 4, wherein the control means produces a shift in both the upper and the lower limits in opposite directions such as to produce the shrinking of the width of the window.

8. A validator according to claim 7 wherein the control means performs the shrinking in incremental steps.

9. A validator according to claim 1 wherein in the normal operating mode, the comparing means compares the coin parameter data with a plurality of said operating windows corresponding to acceptable values for coins of different denominations, and the control means derives said operating window data for each of the operating windows form the initial window data.

10. A validator according to claim 1 wherein said means for producing coin parameter data produces data signals corresponding to a plurality of different parameters for the coin under test, the comparing means compares the data signals with corresponding ones of said windows for said different parameters, and the control means derives said operating window data for each of the windows respectively.

11. A validator according to claim 1 including means for writing the operating window data in the memory means as a result of operation of the set up means.

12. A validator according to claim 1 including means for disabling operation of the set up means after the operating window data has been produced.

13. A plurality of coin validators according to claim 1, with the same initial window data stored in the memory means thereof.

14. A method of manufacturing coin validators each according to claim 1, including storing the same window data for at least one said initial window in all of the validators.

15. A plurality of coin validators each as claims in claim 1 loaded with the same initial window data, prior to operation of the set up means.

16. A method of setting up an operating window in a coin validator which in a normal operating mode produces coin parameter data as a function of a characteristic of a coin under test and compares the coin data with operating window data corresponding to an operating window of acceptable values within a range of values for the coin parameter data, for determining coin acceptability; wherein prior to the setting up the operating window, initial window data has been stored in a memory means in the validator, the initial window data corresponding to an initial window within said range of values, that approximates to the operating window; the setting up method comprising:

performing a validation operation with the validator with a known true coin so as to produce coin parameter test data;

deriving operating window data corresponding to an operating window in said range of values of coin data, by dragging the initial window through the range by an amount determined in response to the coin parameter test data, and shrinking the width of the initial window; and thereafter switching the validator into said normal operating mode in which coin data from coins to be validated are compared with the operating window data for determining coin acceptability.

17. A method according to claim 16 including loading the initial window data into a group of validators, and setting up the operating window for each validator individually.

18. A method according to claim 17 including loading the initial window data at a location remote from the site at which the validator is manufactured.

19. A method according to claim 17 including obtaining the coin parameter test data by passing a plurality of coins of known denomination through the validator.

20. A method according to claim 18 including obtaining the coin parameter test data by passing a plurality of coins of known denomination through the validator.

21. A method according to claim 17, including disabling the setting up method after said operating window data has been produced.

22. A method according to claim 18, including disabling the setting up method after said operating window data has been produced.

23. A method according to claim 16, including obtaining the coin parameter test data by passing a plurality of coins of known denomination through the validator.

24. A method according to claim 23, including disabling the setting up method after said operating window data has been produced.

25. A coin validator with operating windows set up by a method as claimed in claim 16.

26. A method according to claim 16, including disabling the setting up method after said operating window data has been produced.

27. A method according to claim 26 including selectively reactivating the setting up method, loading at least one further set of initial window data, and performing the setting up method again in respect of said further set.

* * * * *